US006372345B1

(12) United States Patent
Wakae et al.

(10) Patent No.: US 6,372,345 B1
(45) Date of Patent: Apr. 16, 2002

(54) COMPOSITE PARTICLES FOR COMPOSITE DISPERSION PLATING AND METHOD OF PLATING THEREWITH

(75) Inventors: Takayuki Wakae, Kawasaki; Akira Tsujimura; Yuichiro Hara, both of Fujisawa; Tadashi Kamimura, Kawasaki; Masaaki Beppu, Tokyo; Eiji Hirai, Tokyo; Seiki Mori, Tokyo, all of (JP)

(73) Assignees: Nihon Parkerizing Co., Ltd.; Isuzu Motors Limited, both of Tokyo (JP)

( * ) Notice: Subject to any disclaimer, the term of this patent is extended or adjusted under 35 U.S.C. 154(b) by 0 days.

(21) Appl. No.: 09/297,393

(22) PCT Filed: Sep. 3, 1998

(86) PCT No.: PCT/JP98/03950

§ 371 Date: Jun. 17, 1999

§ 102(e) Date: Jun. 17, 1999

(87) PCT Pub. No.: WO99/11843

PCT Pub. Date: Mar. 11, 1999

(30) Foreign Application Priority Data

Sep. 3, 1997 (JP) ..... 9-252594

(51) Int. Cl.[7] ..... B32B 9/00; C25D 15/00

(52) U.S. Cl. ..... 428/403; 428/402; 205/109; 205/112; 205/137; 205/140; 205/141; 205/148; 205/271; 205/300; 205/305

(58) Field of Search ..... 384/912, 913, 384/910; 428/403, 402; 205/109, 137, 148, 112, 140, 141, 271, 300, 305

(56) References Cited

U.S. PATENT DOCUMENTS

| | | | | |
|---|---|---|---|---|
| 3,945,893 | A | * | 3/1976 | Ishimori et al. |
| 4,441,965 | A | * | 4/1984 | Matsumura et al. |
| 5,122,418 | A | * | 6/1992 | Nakane et al. |
| 5,184,662 | A | * | 2/1993 | Beane et al. |
| 5,318,797 | A | * | 6/1994 | Matijevic et al. |
| 5,453,293 | A | * | 9/1995 | Beane et al. |

FOREIGN PATENT DOCUMENTS

| | | | |
|---|---|---|---|
| JP | 4-52300 | * | 2/1992 |
| JP | 8-41688 | | 2/1996 |

* cited by examiner

*Primary Examiner*—Deborah Jones
*Assistant Examiner*—Jennifer McNeil
(74) *Attorney, Agent, or Firm*—McCormick, Paulding & Huber LLP

(57) ABSTRACT

The present invention is applicable to composite particles for composite dispersion plating used for forming a self-lubricating composite dispersion coating and a method of plating using such composite particles as well as a plating (coating) using the same. The purpose of the invention is to obtain a composite particle for composite dispersion plating which is comprised of a particle with an excellent capability of reducing the friction and a low or very low specific gravity, and a method of plating using such composite particles. In this invention, each of the composite particles includes a friction-reducing mother or core particle (1) encapsulated with shell particles (2) comprised of the same components as a base metal of a composite dispersion plating bath (5). This provides a composite particle for composite dispersion plating which is comprised of a particle with an excellent capability of reducing the friction and a low or very low specific gravity. As a result, the composite particles can form an eutectic system in a plating layer without addition of any surfactant.

18 Claims, 9 Drawing Sheets

COMPOSITE PARTICLES FOR COMPOSITE DISPERSION PLATING AND METHOD OF PLATING THEREWITH

FIELD OF THE INVENTION

This invention relates to composite particles for composite dispersion plating and to a plating method using the same, and more particularly to composite particles for composite dispersion plating used for a self-lubricating composite dispersion plating film and to a plating method and a plating film or coating that make use of these particles.

BACKGROUND OF THE INVENTION

Composite dispersion plating is a method whereby dispersion particles composed of ceramic particles such as SiC, $Si_3N_4$, BN are codeposited in a plating film composed of a metal matrix of nickel or the like. It is essential that the dispersion particles be suspended in the plating bath. Composite dispersion plating films (such as an Ni—P—BN plating film) are known to be plating films with low friction, and have been applied to sliding member surfaces in internal combustion engines and the like.

Thus, to suspend dispersion particles in a plating bath by the codeposition of dispersion particles with a low specific gravity in a plating bath, the most common approach is to add a surfactant to the plating bath, but this causes various problems, such as the generation of bubbles in the plating bath and changes in the internal stress of the plating film.

An example of a method for the codeposition of dispersion particles with a low specific gravity in a plating bath without the addition of a surfactant is a method in which core particles (mother particles) composed of an organic substance are encapsulated with shell particles composed of a ceramic to form composite particles, and these composite particles are codeposited as dispersion particles in a plating bath (Japanese Patent Application Laid-Open Publication No. 8-41688).

A method in which carbon (graphite), which has excellent friction reducing properties, is codeposited as dispersion particles or composite particles has been tried in an effort to diminish the adverse effect on mated sliding members, that is, in an effort to obtain a plating film with lower friction.

However, no matter which conventional method is used (a method in which a surfactant is added to the plating bath, or a method in which composite particles are codeposited in the plating bath), it is extremely difficult for particles with a very low specific gravity, such as carbon, to be codeposited as dispersion particles or composite particles in a plating bath.

SUMMARY OF THE INVENTION

In view of this, an object of the present invention is to solve the above problems and provide composite particles for composite dispersion plating constituted by particles having excellent friction reducing properties and a low or very low specific gravity, and a plating method in which these composite particles are used.

The composite particles for composite dispersion plating according to the present invention are produced by the encapsulation of the surface of a core particle having excellent friction reducing properties and a low specific gravity with shell particles composed of the same components as the base metal of the composite dispersion plating bath.

It is preferable here for the core particle to be composed of carbon. This will allow composite particles for composite dispersion plating with excellent friction reducing properties to be obtained, which in turn allows a composite dispersion plating film with lower friction to be obtained. Alternatively, the core particle may be $Fe_3O_4$.

It is also favorable for the shell particles to be selected from among nickel (Ni), copper (Cu), tin (Sn), aluminum (Al), chromium (Cr), iron (Fe) and zinc (Zn). This will cause the shell particles to dissolve in the base metal of the plating film during the formation of the composite dispersion plating film, and as a result the core particles themselves will be dispersed in the plating layer.

The composite particles for composite dispersion plating is constituted by particles with excellent friction reducing properties and a low or very low specific gravity.

The plating method that makes use of composite particles for composite dispersion plating pertaining to the present invention is such that the material to be plated is immersed in a composite dispersion plating bath produced by the codeposition of composite particles in which the surface of a core particle used for reducing friction is encapsulated by shell particles composed of the same components as the base metal of the composite dispersion plating bath, after which a plating film in which the composite particles have been codeposited in the plating layer is formed on the surface of the material to be plated.

It is preferable here for the composite particles to be formed by mixing the core particles used for reducing friction with the shell particles composed of the same components as the base metal of the composite dispersion plating bath in a predetermined weight ratio, and then performing mechanical encapsulation.

It is also preferable for an electrolytic material to be immersed along with the material to be plated in the composite dispersion plating bath, and then for electroplating to be carried out using the material to be plated as the cathode and the electrolytic material as the anode to form the plating film.

It is also preferred that the plating solution of the composite dispersion plating bath is circulated and air is blown into the plating bath to agitate the plating solution during the electroplating.

The material to be plated is preferably moved up and down during said electroplating.

With the plating method utilizing the composite particles for composite dispersion plating according to the present invention, particles with excellent friction reducing properties and a low or very low specific gravity can be been codeposited in the plating layer without the addition of a surfactant.

The plating film which makes use of composite particles for composite dispersion plating pertaining to the present invention is produced by codepositing in the plating layer composite particles in which the surface of a core particle used for reducing friction is encapsulated by shell particles composed of the same components as the base metal of the composite dispersion plating bath.

The plating film which makes use of composite particles for composite dispersion plating pertaining to the present invention can be applied to sliding members in internal combustion engine ("engine") parts. For example, if the composite dispersion plating film which makes use of composite particles for composite dispersion plating according to the present invention is formed on the inner surface of a cylinder, the inner surface of a cylinder liner, the sliding surface of a piston, the sliding surface of a cylinder block, the sliding surface of a connecting rod big end, or the surface of a crankshaft in slidable contact with the connecting rod, a plating film of lower friction than conventional low-friction plating films will be formed on the surface (sliding surface) of these various members, thereby reducing the adverse effect on mated sliding members.

DETAILED DESCRIPTION OF THE PREFERRED EMBODIMENT

An embodiment of the present invention will now be described in detail through reference to the appended figures.

Figure 1:
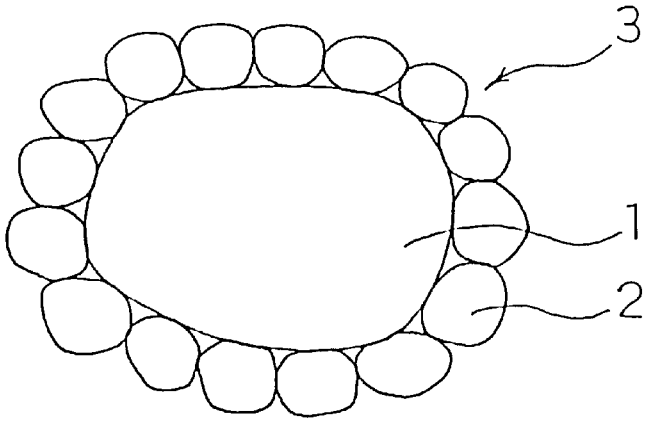
FIG. 1 schematically illustrates one of composite particles for composite dispersion plating according to the present invention.

FIG. 1 is a type diagram showing one of the composite particles for composite dispersion plating according to the present invention.

As illustrated in FIG. 1, each of the composite particles for composite dispersion plating 3 of the present invention is produced by encapsulating the surface of a core particle 1 having excellent friction reducing properties and a low or very low specific gravity with shell particles 2 composed of the same components as the base metal of the composite dispersion plating bath ("plating bath").

The core particle 1 may be carbon or $Fe_3O_4$. It is favorable for the diameter of the carbon particles to be about 5 to 10 $\mu$m, but the diameter may be 1 to 30 $\mu$m depending on the type of shell particles 2. It is favorable for the diameter of the $Fe_3O_4$ particles to be about 1 to 25 $\mu$m.

The shell particles 2 are selected from among nickel, copper, tin, aluminum, chromium, iron, and zinc, and are to be the same metal as the base metal of the composite dispersion plating bath being used. It is favorable for the diameter of nickel particles and copper particles to be no more than 1 $\mu$m, for the diameter of tin particles to be about 10 $\mu$m, and for the diameter of aluminum particles to be about 3 $\mu$m.

Specifically, if the composite particles for composite disperse plating according to the invention is employed, a plating film can be formed on the surface of the material to be plated without the addition of a surfactant since the surface of carbon or $Fe_3O_4$ particles, which have excellent friction reducing properties but with which a surfactant had to be added in the past because of their very low specific gravity, is encapsulated (through mechanical retention) with shell particles composed of the same components as the base metal of the composite dispersion plating bath.

The method for manufacturing the composite dispersion plating-use composite particles 3 will now be described.

Core particles 1 and shell particles 2 that have been prepared ahead of time are mixed in a specific ratio (weight ratio), after which they are subjecting to premixing (OM treatment) in a hybridizer, which is a mechano-chemical process, and are subjected to encapsulation at a predetermined rotational speed, thereby producing the composite particles 3.

Next, the plating method which makes use of the composite dispersion plating-use composite particles 3 of the present invention will be described.

Figure 2:
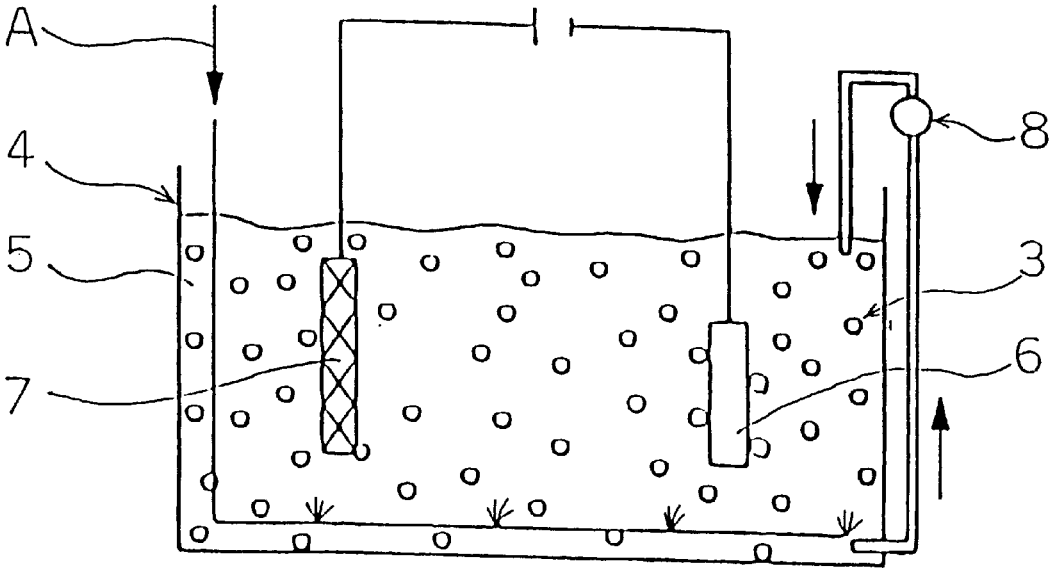
FIG. 2 is a schematic illustration useful to explain the plating method which makes use of composite particles for composite dispersion plating according to the present invention.

FIG. 2 is a schematic illustration useful to describe the plating method which makes use of the composite particles for composite dispersion plating according to the present invention. Those members that are the same as in FIG. 1 are labeled the same.

First, a plating bath tank 4 is filled with a plating solution (such as a nickel plating solution) 5, and composite particles 3, in which the periphery of each core particle (such as a carbon particle; not shown) 1 is encapsulated with shell particles (such as nickel particles; not shown) 2 of the same metal as the base metal of the plating solution 5, are dispersed in this plating solution 5, which results in the codeposition of the composite particles 3 in the plating solution 5.

Next, the material to be plated 6 and an electrolytic material (such as a nickel material) 7 are immersed in this plating solution 5, and electroplating is carried out by connecting the material to be plated 6 to a cathode and the electrolytic material 7 to an anode. The plating solution 5 is circulated during this time by a pump 8 provided on the outside of the plating bath tank 4. Air A is also blown into the plating solution 5 using air supply means (not shown) so as to agitate the plating solution 5. Furthermore, the material to be plated 6 is moved up and down by a shaking means (not shown).

This electroplating forms a composite dispersion plating film, in which the composite particles 3 have been codeposited in the plating layer, on the surface of the material to be plated 6.

EXAMPLE 1

First, using carbon particles with a diameter of approximately 20 μm and a density of 2.27 g/cm$^3$ as the core particles and using nickel particles with a diameter of no more than 1 μm and a density of 8.91 g/cm$^3$ as the shell particles, these core particles and shell particles were mixed in a weight ratio of 40.0:60.0.

Next, this mixed powder was subjected to premixing in a hybridizer for 5 minutes at a speed of 1,500 rpm, and then subjected to encapsulation for 2 minutes at a speed of 5,000 rpm to form composite particles.

EXAMPLE 2

First, using carbon particles with a diameter of approximately 35 to 105 μm and a density of 2.27 g/cm$^3$ as the core particles and using tin particles with a diameter of approximately 10 μm and a density of 7.29 g/cm$^3$ as the shell particles, these core particles and shell particles were mixed in a weight ratio of 34.6:65.4.

After this, composite particles were formed in the same manner as in Example 1.

EXAMPLE 3

First, using the carbon particles of Example 1 as the core particles and using aluminum particles with a diameter of approximately 3 μm and a density of 2.70 g/cm$^3$ as the shell particles, these core particles and shell particles were mixed in a weight ratio of 34.4:65.6.

After this, composite particles were formed in the same manner as in Example 1.

EXAMPLE 4

First, using $Fe_3O_4$ particles with a diameter of approximately 5 to 25 μm and a density of 5.16 g/cm$^3$ as the core particles and using nickel particles with a diameter of no more than 1 μm and a density of 8.91 g/cm$^3$ as the shell particles, these core particles and shell particles were mixed in a weight ratio of 70.8:29.2.

After this, composite particles were formed in the same manner as in Example 1.

EXAMPLE 5

First, using the $Fe_3O_4$ particles of Example 4 as the core particles and using copper particles with a diameter of no more than 1 μm and a density of 8.93 g/cm$^3$ as the shell particles, these core particles and shell particles were mixed in a weight ratio of 70.8:29.2.

After this, composite particles were formed in the same manner as in Example 1.

EXAMPLE 6

First, using the $Fe_3O_4$ particles of Example 4 as the core particles and using aluminum particles with a diameter of approximately 3 μm and a density of 2.70 g/cm$^3$ as the shell particles, these core particles and shell particles were mixed in a weight ratio of 67.9:32.1.

After this, composite particles were formed in the same manner as in Example 1.

FIGS. 3 to 10 are SEM views of the various composite particles, carbon core particles, and $Fe_3O_4$ core particles of Examples 1 to 6.

Figure 3:
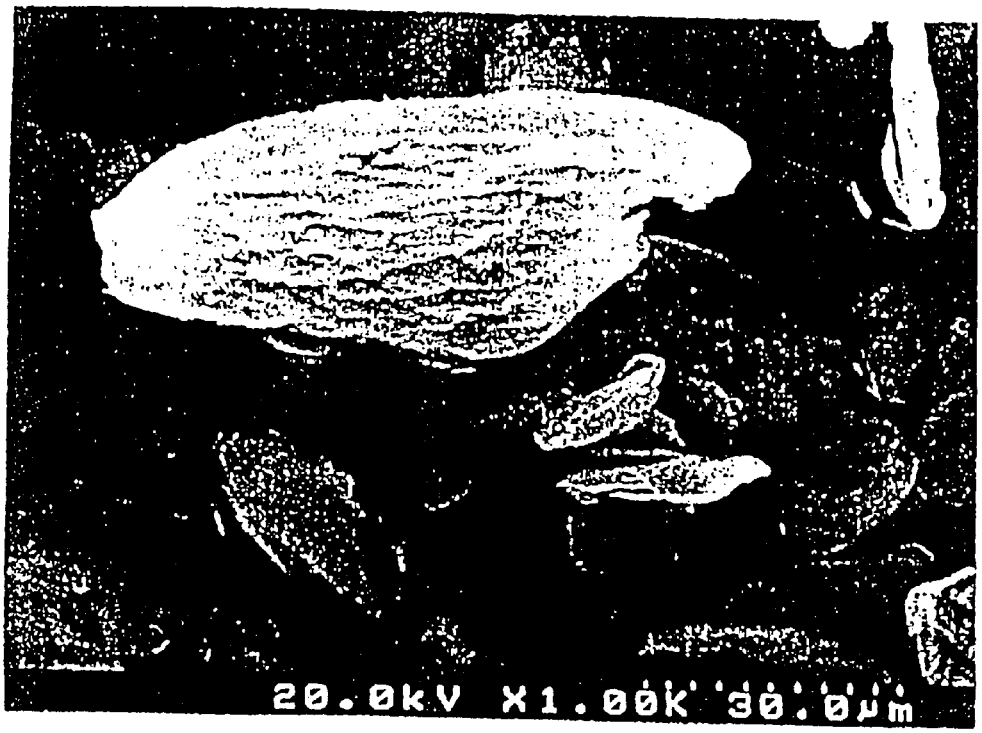
FIG. 3 is an SEM view of carbon particles that serve as core particles of the composite particles for composite dispersion plating of the present invention.
Figure 4:
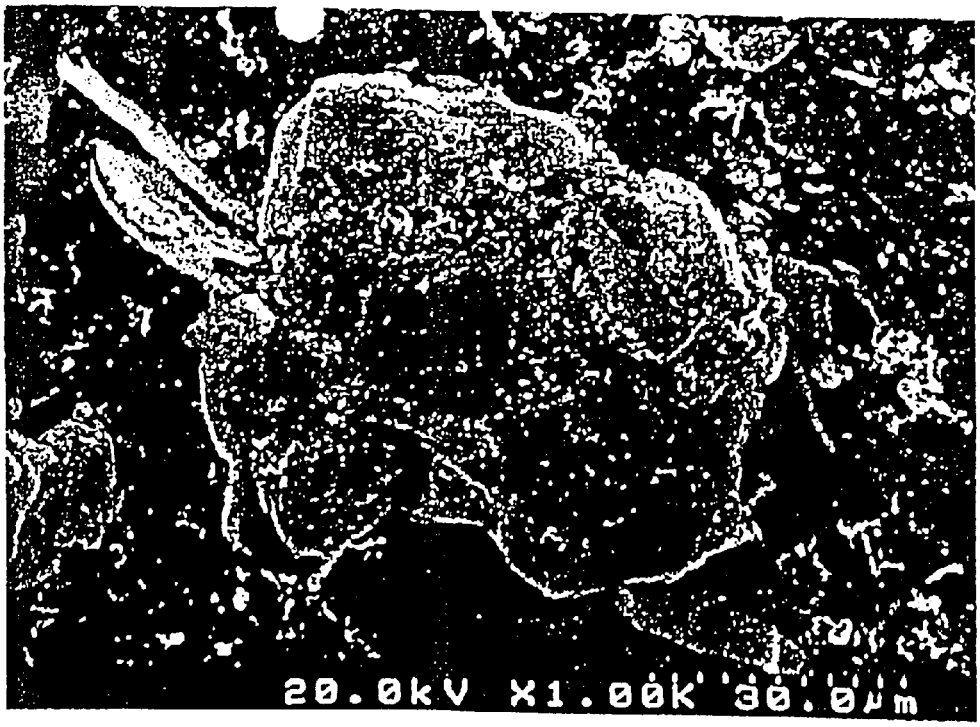
FIG. 4 is an SEM view of the composite particle in Example 1.
Figure 5:
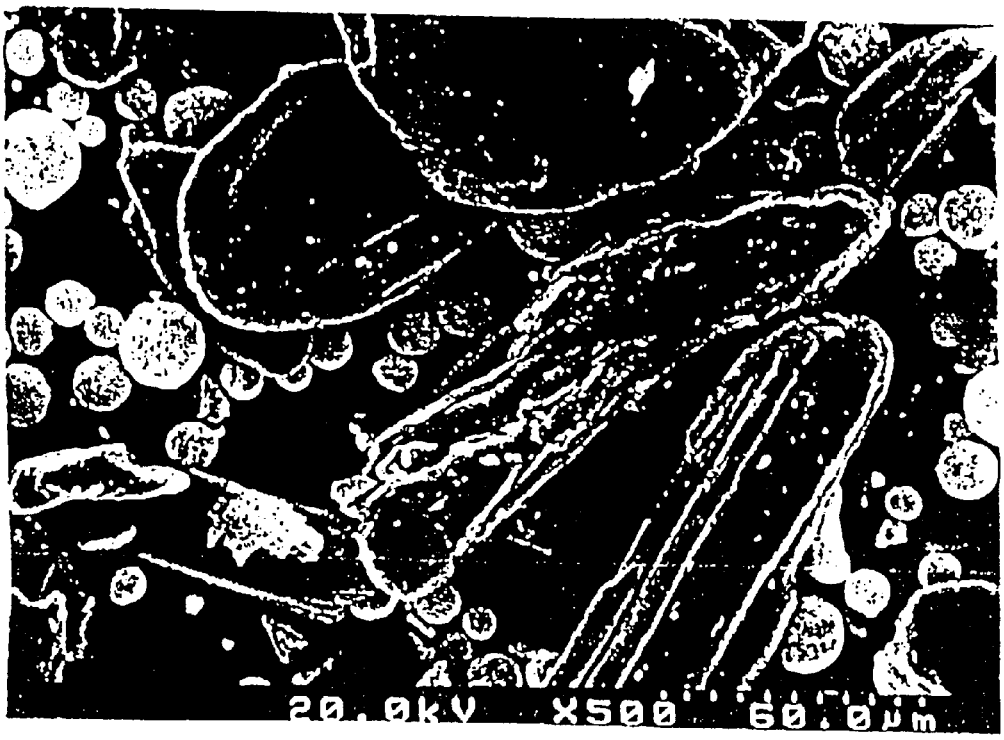
FIG. 5 is an SEM view of the composite particles in Example 2.
Figure 6:
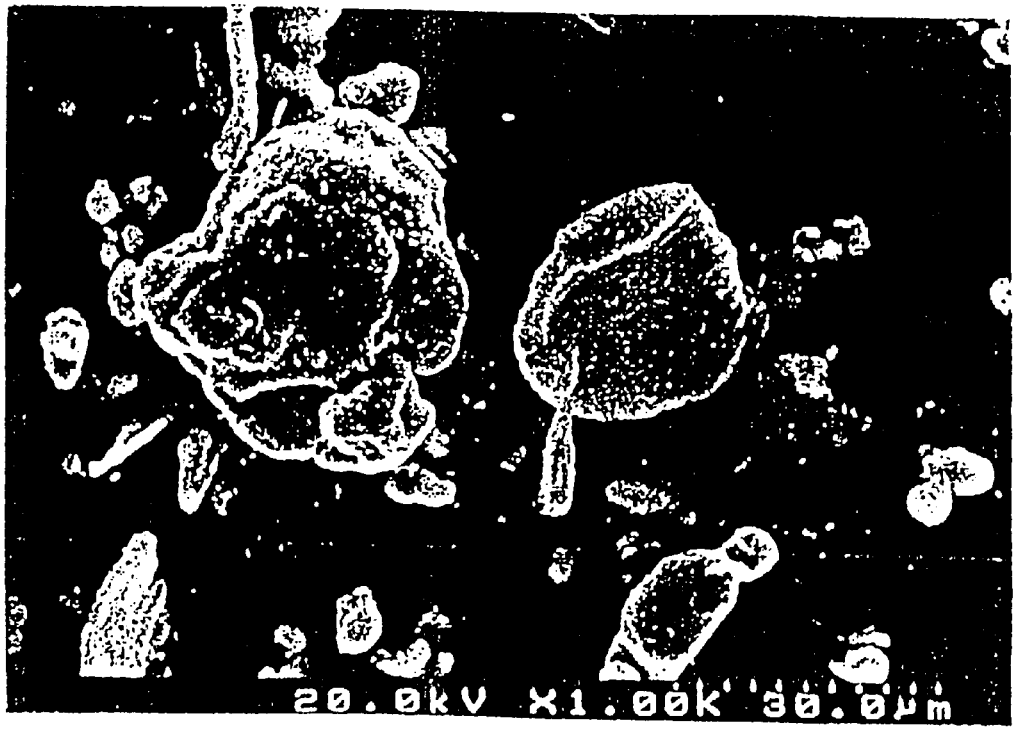
FIG. 6 is an SEM view of the composite particles in Example 3.
Figure 7:
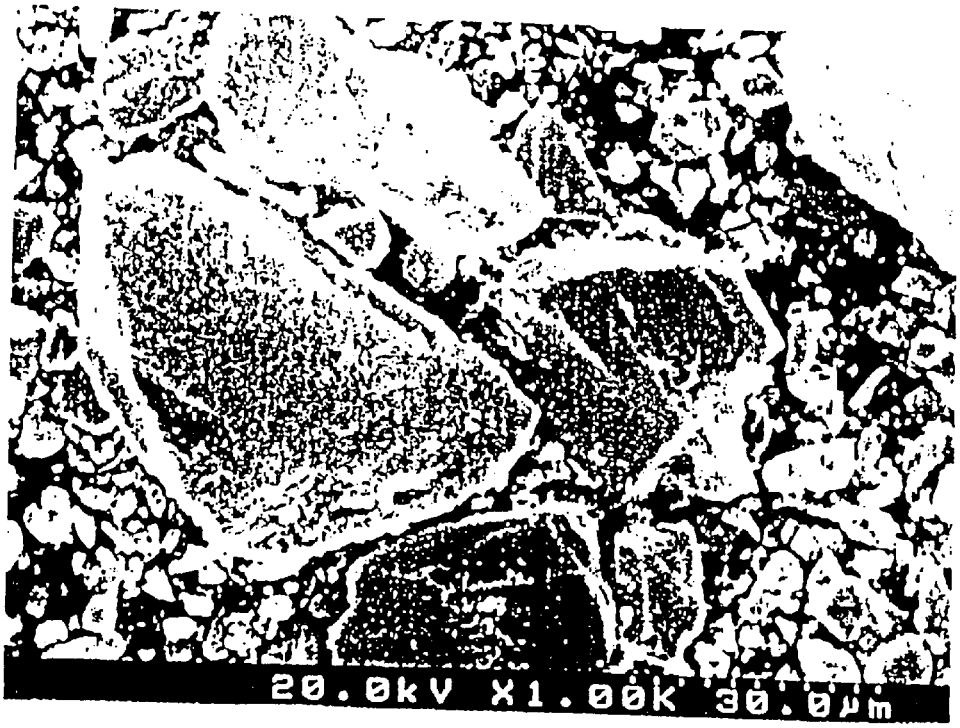
FIG. 7 is an SEM view of $Fe_3O_4$ particles that serve as the core particles in the composite particles for composite dispersion plating of the present invention.
Figure 8:
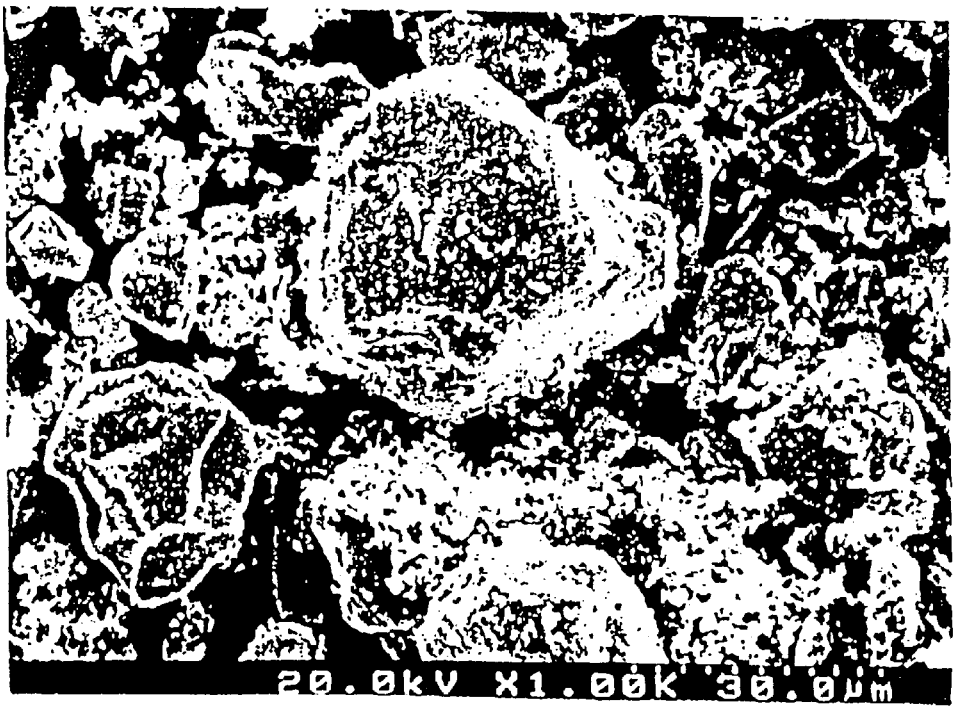
FIG. 8 is an SEM view of the composite particles in Example 4.
Figure 9:
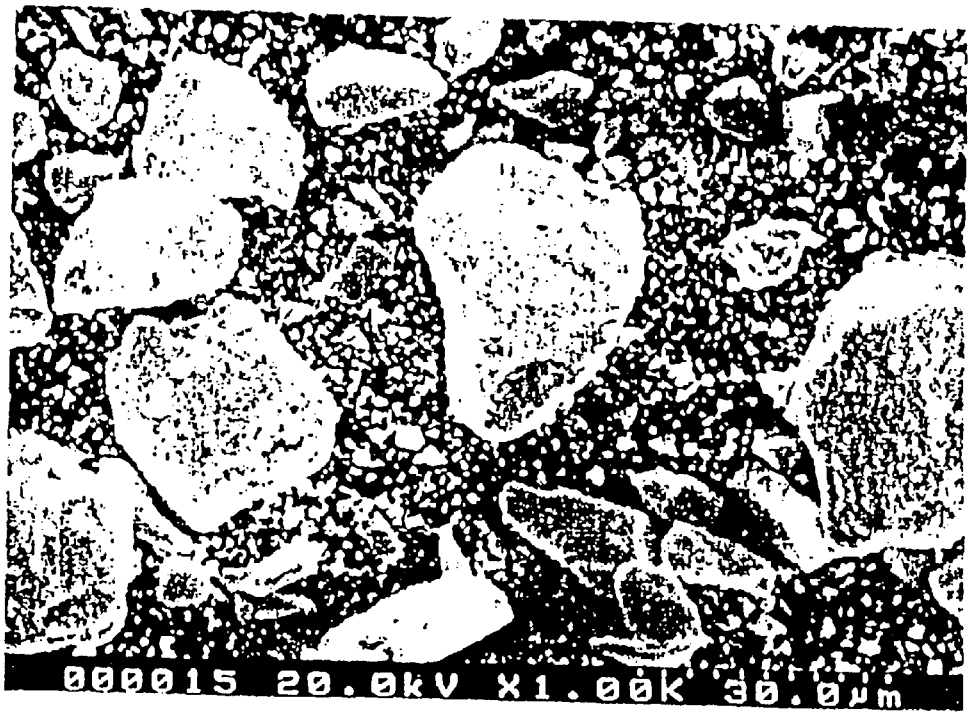
FIG. 9 is an SEM view of the composite particles in Example 5.
Figure 10:
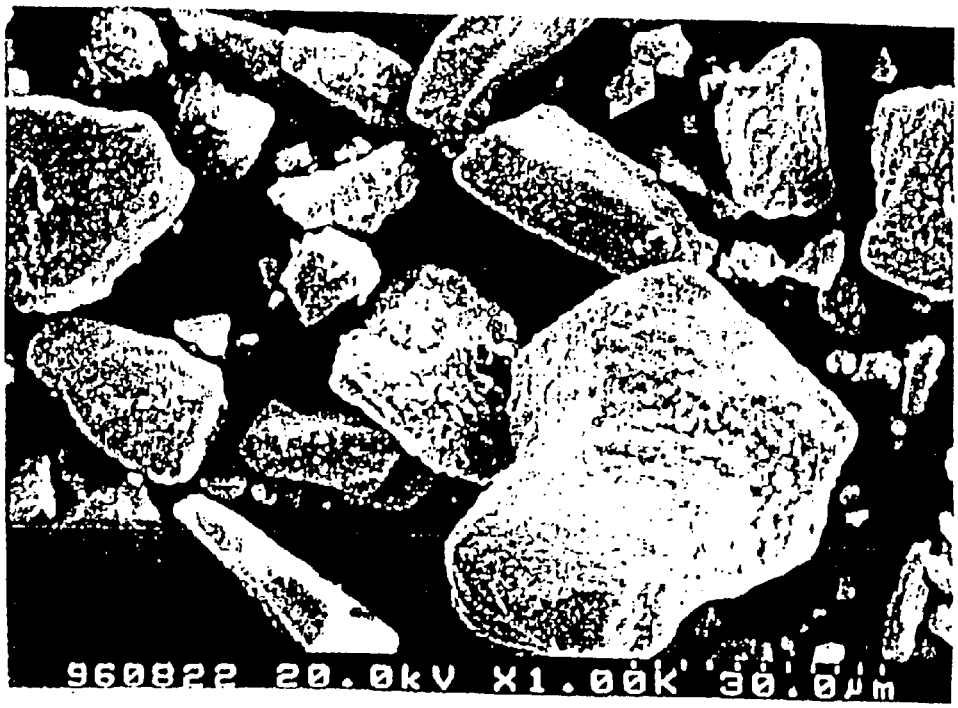
FIG. 10 is an SEM view of the composite particles in Example 6.

Compared to the carbon core particles and $Fe_3O_4$ core particles shown in FIGS. 3 and 7, the composite particles of FIGS. 4 to 6 and FIGS. 8 to 10 look rounder and less angular overall because the surface of each core particle is covered with shell particles.

FIGS. 11 to 16 are optical micrographs of cross sections of the various composite particles in Examples 1 to 6.

Figure 11:
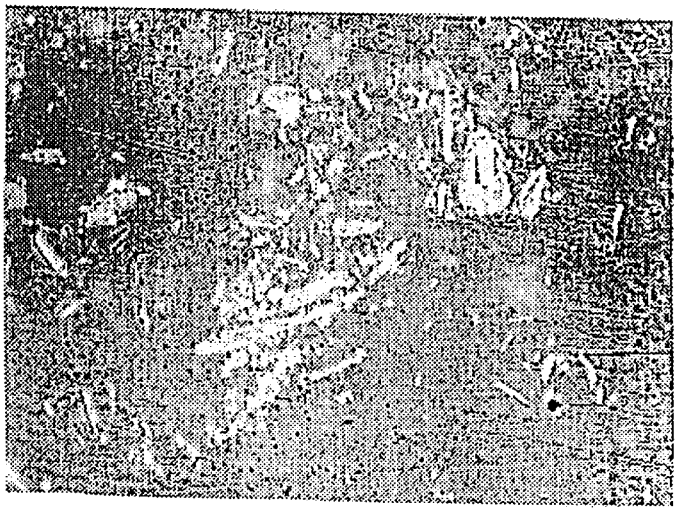
FIG. 11 is an optical micrograph of a cross section of the composite particles in Example 1.
Figure 12:
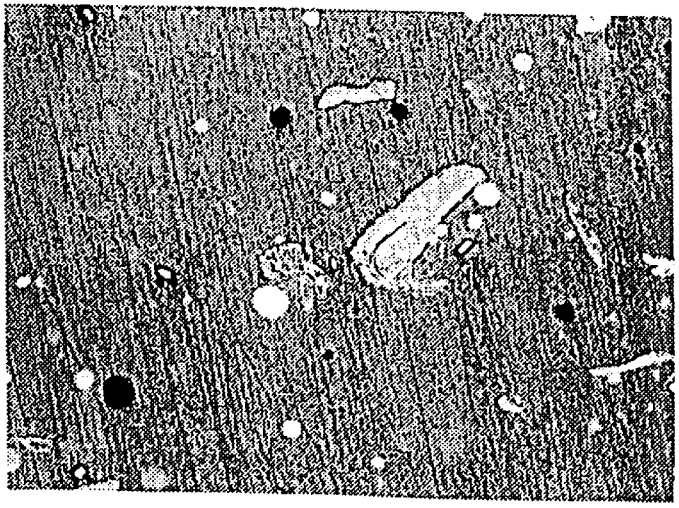
FIG. 12 is an optical micrograph of a cross section of the composite particles in Example 2.
Figure 13:
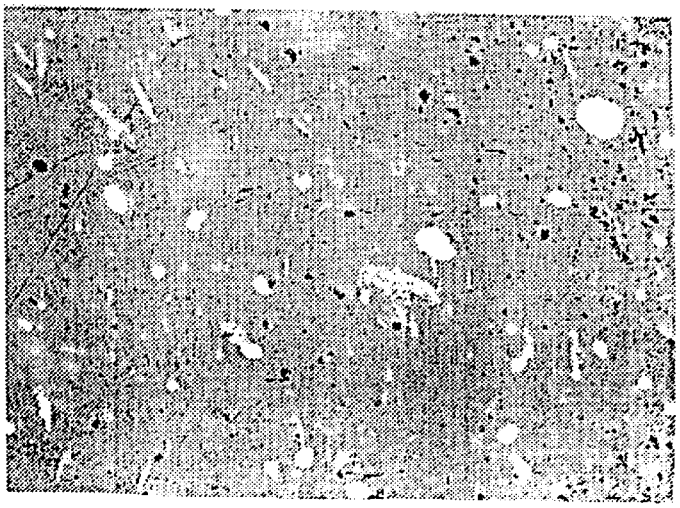
FIG. 13 is an optical micrograph of a cross section of the composite particles in Example 3.
Figure 14:
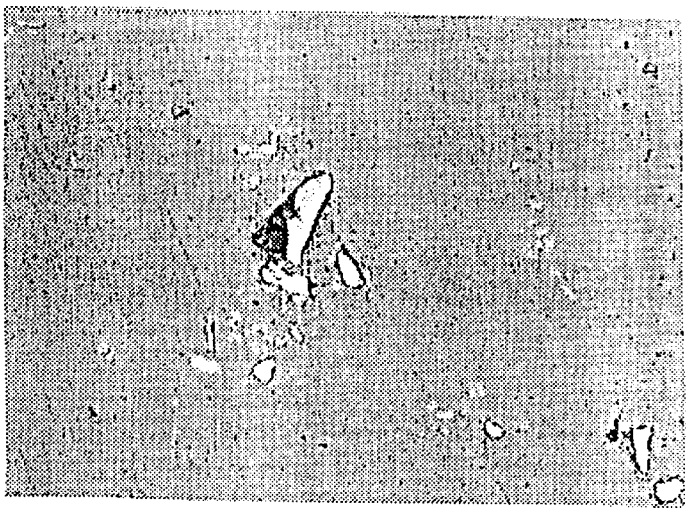
FIG. 14 is an optical micrograph of a cross section of the composite particles in Example 4.
Figure 15:
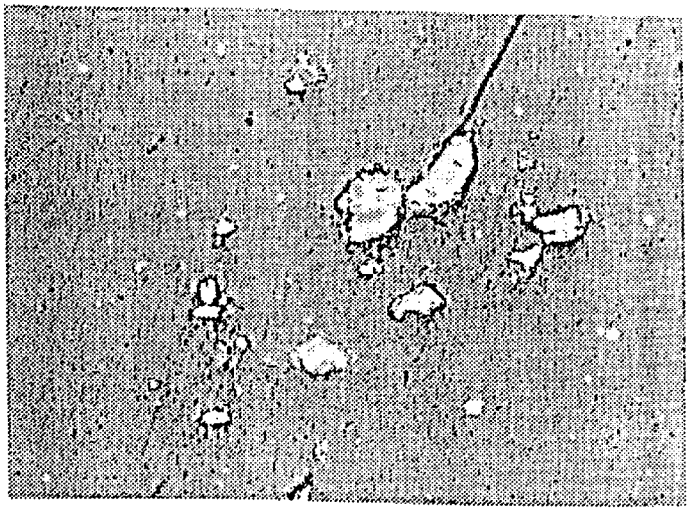
FIG. 15 is an optical micrograph of a cross section of the composite particles in Example 5.
Figure 16:
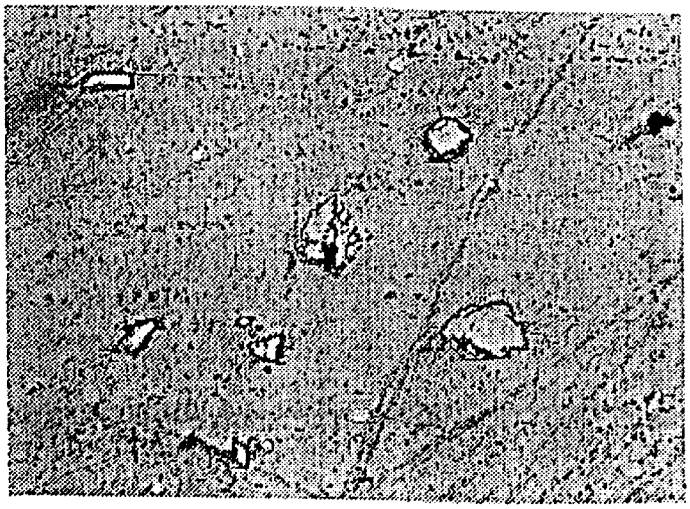
FIG. 16 is an optical micrograph of a cross section of the composite particles in Example 6.

In FIGS. 11 to 13 it is somewhat difficult to see how the surfaces of the carbon core particles are covered with shell particles, but in FIGS. 14 to 16 it can be plainly seen that the surfaces of the $Fe_3O_4$ core particles are covered with the shell particles.

EDX elemental mapping analysis of the $Fe_3O_4$/nickel composite particles of Example 4 revealed that the surfaces of the $Fe_3O_4$ core particles were encapsulated by nickel shell particles.

EXAMPLE 7

The carbon/nickel composite particles of Example 1 were dispersed in a nickel-phosphorus plating bath, and the suspension amount of the nickel-phosphorus plating bath was set at 50 g/l. A material to be plated made of aluminum was immersed in this nickel-phosphorus plating bath, and electroplating was performed such that the thickness of the Ni—P—C/Ni plating film would be about 50 μm.

EXAMPLE 8

The carbon/nickel composite particles of Example 1 were dispersed in a nickel-phosphorus plating bath, and the suspension amount of the nickel-phosphorus plating bath was set at 80 g/l. A material to be plated made of aluminum was immersed in this nickel-phosphorus plating bath, and electroplating was performed such that the thickness of the Ni—P—C/Ni plating film would be about 50 μm.

COMPARATIVE EXAMPLE 1

The carbon/nickel composite particles of Example 1 were dispersed in a nickel-phosphorus plating bath, the suspension amount of the nickel-phosphorus plating bath was set at 80 g/l, and a surfactant was added. A material to be plated made of aluminum was immersed in this nickel-phosphorus plating bath, and electroplating was performed such that the thickness of the Ni—P—C/Ni plating film would be about 50 μm.

It was visually confirmed that the composite particles did not float on the nickel-phosphorus plating bath and that the suspendability thereof was good even when the carbon-nickel composite particles were dispersed in the nickel-phosphorus plating bath without the surfactant being added.

Figure 17A:
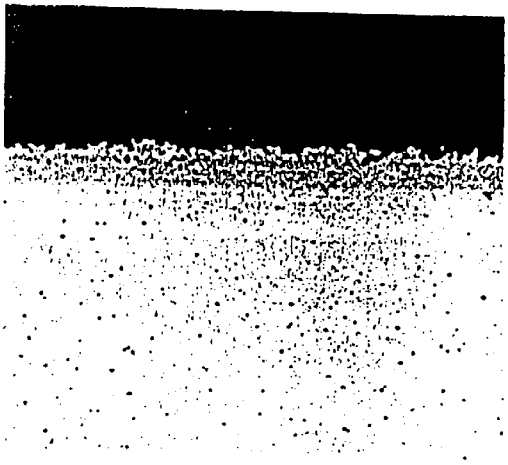
FIG. 17*a* is a cross section of the Ni—P—C/Ni plating film of Example 7.
Figure 17B:
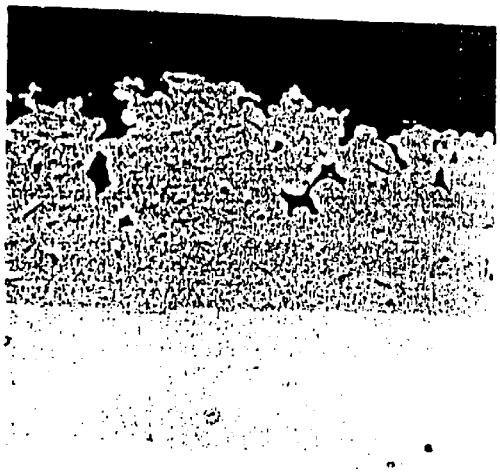
FIG. 17*b* is an enlarged view of FIG. 17*a;*
Figure 18A:
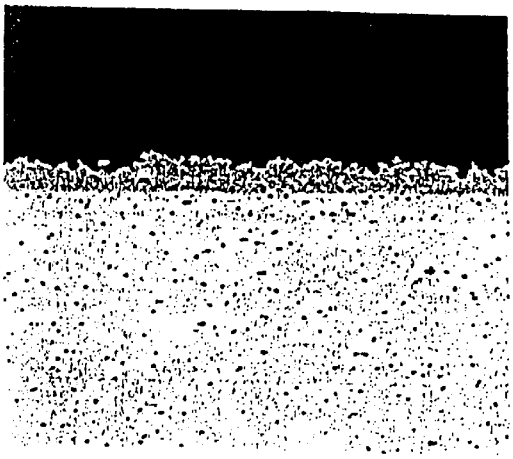
FIG. 18*a* is a cross section of the Ni—P—C/Ni plating film of Example 8.
Figure 18B:
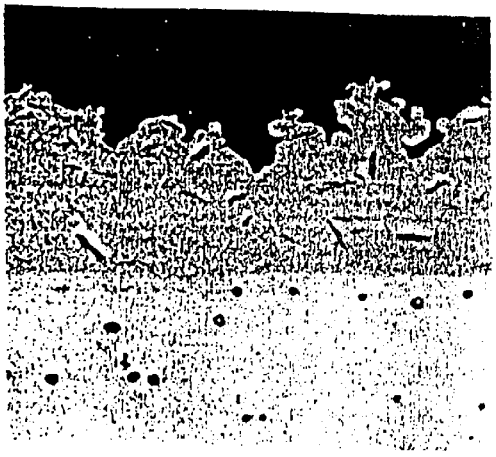
FIG. 18*b* is an enlarged view of FIG. 18*a;*
Figure 19A:
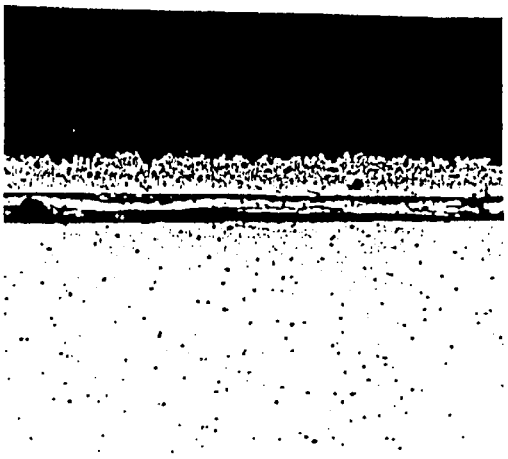
FIG. 19*a* is a cross section of the Ni—P—C/Ni plating film of Comparative Example 1.
Figure 19B:
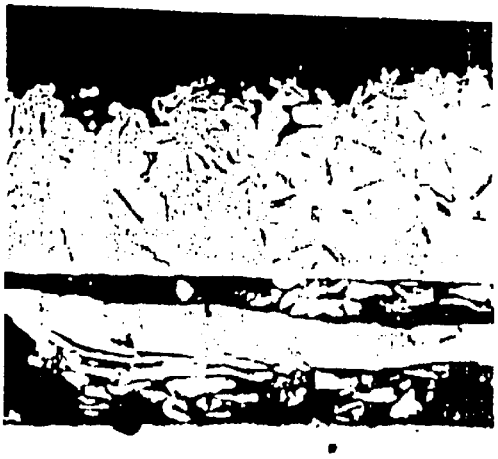
FIG. 19*b* is an enlarged view of FIG. 19*a*.

Cross sections of the Ni—P—C/Ni plating films of Examples 7 and 8 and Comparative Example 1 are illustrated in FIGS. 17*a*, 17*b*, 18*a*, 18*b*, 19*a* and 19*b*. FIG. 17*a* is a cross section of the Ni—P—C/Ni plating film of Example 7, FIG. 17*b* is an enlarged view of FIG. 17*a*, FIG. 18*a* is a cross section of the Ni—P—C/Ni plating film of Example 8, FIG. 18*b* is an enlarged view of FIG. 18*a*, FIG. 19*a* is a cross section of the Ni—P—C/Ni plating film of Comparative Example 1, and FIG. 19*b* is an enlarged view of FIG. 19*a*.

As illustrated in FIGS. 17*a*, 17*b*, 18*a* and 18*b*, when electroplating was performed with the composite particles of the present invention being co-deposited in the plating solution, a good C/Ni—P plating film was obtained with no interlayer separation whatsoever between the plated material and the plating film. A larger amount of carbon was dispersed in the Ni—P—C/Ni plating film of Example 8, in which the suspended amount of composite particles was larger, than in the Ni—P—C/Ni plating film of Example 7.

In contrast, as shown in FIGS. 19*a* and 19*b*, interlayer separation between the plated material and the plating film was observed when electroplating was performed with a surfactant being added during the co-deposition of the composite particles of the present invention in the plating solution.

Now, let's evaluate the surface roughness of the Ni—P—C/Ni plating films of Examples 7 and 8 and Comparative Example 1. This evaluation of surface roughness was conducted for the center line average roughness Ra (μm), the ten-point average roughness Rz (μm), and the average maximum height Rmax (μm). These evaluation results are given in Table 1.

TABLE 1

| Example | Category | | |
|---|---|---|---|
| | Center line av. roughness Ra (μm) | Ten-point average roughness Rz (μm) | Average maximum height Rmax (μm) |
| Example 7 | 2.56 (2.05–3.33) | 15.15 (13.46–17.38) | 19.29 (14.88–25.32) |
| Example 8 | 2.61 (1.64–3.82) | 15.76 (10.48–21.85) | 21.87 (13.02–38.17) |
| Comparative Example 1 | 3.03 (2.32–3.73) | 18.20 (13.68–21.82) | 23.50 (16.79–28.31) |

As shown in Table 1, the Ni—P—C/Ni plating films of Examples 7 and 8 had a center line average roughness of 2.56 μm and 2.61 μm, respectively, a ten-point average roughness of 15.15 μm and 15.76 μm, respectively, and an average maximum height of 19.29 μm and 21.87 μm, respectively, while the Ni—P—C/Ni plating film of Comparative Example 1 had a center line average roughness of 3.03 μm, a ten-point average roughness of 18.20 μm, and an average maximum height of 23.50 μm, which means that the plating films of the present invention were more uniform.

Next, the cross sectional hardness of the Ni—P—C/Ni plating films of Examples 7 and 8 and Comparative Example 1 were measured. "Cross sectional hardness" indicates the average value of cross sectional hardness ($Hmv_{0.1}$) The thickness (μm) of the plating films was also measured. These measurement results are given in Table 2.

TABLE 2

| Example | Category | |
|---|---|---|
| | Cross sectional av. hardness ($Hmv_{0.1}$) | Plating film thickness (μm) |
| Example 7 | 419 (339–466) | 62 |
| Example 8 | 292 (264–304) | 51 |
| Comparative Example 1 | 291 (269–319) | 52 |

A friction test was then conducted for the Ni—P—C/Ni plating films of Examples 7 and 8 and Comparative Example 1 having the above-mentioned cross sectional hardness, and for an Ni—P—BN plating film, which is known as a low-friction plating film. Here, an Ni—P—BN plating film in which BN with a small particle diameter was used is termed Comparative Example 2, while an Ni—P—BN plating film in which BN with a large particle diameter was used is termed Comparative Example 3.

The friction test was conducted using a Bowden friction/wear tester, with an aluminum alloy that had undergone an NCC coating treatment (#1000 finish) as the substrate, and SUJ-2 with a diameter of 5 mm as the companion material. The load was 5 kgf, the lubricating oil was 0.5 cc of engine oil (5W-30), the number of slides was 1 to 200, the sliding distance was 10 mm, and the sliding rate was 10 mm/sec. The results of the friction test are given in Table 3.

TABLE 3

| Coefficient of friction | Example | | | | Comparative Example | | | | | |
|---|---|---|---|---|---|---|---|---|---|---|
| | 7 | | 8 | | 1 | | 2 | | 3 | |
| Number of slides | 1st time | 2nd time | 1st time | 2nd time | 1st time | 2nd time | 1st time | 2nd time | 1st time | 2nd time |
| 1 | 0.10 | 0.09 | 0.09 | 0.10 | 0.09 | 0.09 | 0.15 | 0.15 | 0.17 | 0.17 |
| 10 | 0.08 | 0.08 | 0.07 | 0.07 | 0.07 | 0.07 | 0.13 | 0.14 | 0.14 | 0.12 |
| 20 | 0.08 | 0.08 | 0.07 | 0.07 | 0.07 | 0.07 | 0.13 | 0.13 | 0.14 | 0.12 |
| 30 | 0.08 | 0.08 | 0.07 | 0.07 | 0.07 | 0.07 | 0.12 | 0.13 | 0.12 | 0.12 |
| 40 | 0.08 | 0.08 | 0.07 | 0.07 | 0.07 | 0.07 | 0.13 | 0.14 | 0.12 | 0.12 |
| 50 | 0.07 | 0.08 | 0.07 | 0.07 | 0.07 | 0.07 | 0.12 | 0.13 | 0.12 | 0.12 |
| 60 | 0.07 | 0.08 | 0.07 | 0.07 | 0.07 | 0.07 | 0.13 | 0.14 | 0.12 | 0.12 |
| 70 | 0.07 | 0.08 | 0.07 | 0.07 | 0.07 | 0.07 | 0.12 | 0.13 | 0.12 | 0.12 |
| 80 | 0.07 | 0.07 | 0.07 | 0.07 | 0.07 | 0.07 | 0.13 | 0.14 | 0.12 | 0.12 |
| 90 | 0.07 | 0.08 | 0.07 | 0.07 | 0.07 | 0.07 | 0.13 | 0.12 | 0.12 | 0.12 |
| 100 | 0.07 | 0.08 | 0.07 | 0.07 | 0.07 | 0.07 | 0.13 | 0.13 | 0.12 | 0.12 |
| 110 | 0.07 | 0.07 | 0.07 | 0.07 | 0.07 | 0.07 | 0.13 | 0.14 | 0.12 | 0.12 |
| 120 | 0.07 | 0.08 | 0.07 | 0.07 | 0.07 | 0.07 | 0.12 | 0.12 | 0.12 | 0.12 |
| 130 | 0.07 | 0.07 | 0.07 | 0.07 | 0.07 | 0.07 | 0.13 | 0.13 | 0.12 | 0.12 |
| 140 | 0.07 | 0.07 | 0.07 | 0.07 | 0.07 | 0.07 | 0.13 | 0.13 | 0.12 | 0.12 |
| 150 | 0.07 | 0.07 | 0.07 | 0.07 | 0.07 | 0.07 | 0.12 | 0.13 | 0.12 | 0.12 |
| 160 | 0.07 | 0.07 | 0.07 | 0.07 | 0.07 | 0.07 | 0.13 | 0.12 | 0.12 | 0.12 |
| 170 | 0.08 | 0.07 | 0.07 | 0.07 | 0.07 | 0.08 | 0.12 | 0.12 | 0.12 | 0.12 |
| 180 | 0.07 | 0.08 | 0.07 | 0.07 | 0.07 | 0.07 | 0.14 | 0.13 | 0.12 | 0.12 |

TABLE 3-continued

| | Example | | | | Comparative Example | | | | | |
|---|---|---|---|---|---|---|---|---|---|---|
| | 7 | | 8 | | 1 | | 2 | | 3 | |
| Coefficient of friction | 1st time | 2nd time | 1st time | 2nd time | 1st time | 2nd time | 1st time | 2nd time | 1st time | 2nd time |
| 190 | 0.07 | 0.07 | 0.07 | 0.07 | 0.07 | 0.07 | 0.13 | 0.12 | 0.12 | 0.12 |
| 200 | 0.07 | 0.07 | 0.07 | 0.07 | 0.07 | 0.07 | 0.12 | 0.13 | 0.12 | 0.12 |

As shown in Table 3, the coefficient of friction for 1 to 200 slides of the Ni—P—C/Ni plating films of Examples 7 and 8 was 0.07 to 0.10, which is approximately the same as the coefficient of friction for 1 to 200 slides of the Ni—P—C/Ni plating film of Comparative Example 1 (0.07 to 0.09).

In contrast, the coefficient of friction for 1 to 200 slides of the Ni—P—BN plating films of Comparative Examples 2 and 3 was 0.12 to 0.17.

In other words, the friction coefficient of the Ni—P—C/Ni plating films of Examples 7 and 8 is reduced by approximately 45% compared to the friction coefficient of the Ni—P—BN plating films of Comparative Examples 2 and 3, and the former can be seen to be plating films with lower friction.

INDUSTRIAL APPLICABILITY

A composite dispersion plating film that makes use of the composite particles for composite dispersion plating according to the present invention can be applied to the inner surface of a cylinder in an internal combustion engine (a gasoline or diesel engine), the inner surface of a cylinder liner, the sliding surface of a piston, the inner surface of a cylinder block, the sliding surface of a connecting rod big end, the surface of a crankshaft in slide contact with the connecting rod, or the like.

What is claimed is:

1. A composite particle for composite dispersion electroplating using a plating bath having a base metal as its basis, and wherein an electric voltage is applied between the bath and a material to be plated, said composite particle comprising:

a core particle composed of material selected from the group consisting of carbon and $Fe_3O_4$; and a non-uniform shell composed of a plurality of separate shell particles encapsulating the core particle, the shell particles being composed of material selected from the group consisting of nickel, tin and zinc.

2. A composite dispersion electroplating method using a plating bath having a base metal as its basis, comprising:

preparing a composite dispersion plating bath including composite particles, each of the composite particles having a core particle and a non-uniform shell composed of a plurality of separate shell particles encapsulating the core particle, the shell particles being composed of material selected from the group consisting of nickel, tin and zinc, and the core particle being composed of material selected from the group consisting of carbon and $Fe_3O_4$;

immersing a material having a surface to be plated in the composite dispersion plating bath; and applying an electrical potential between the plating bath and the material to form an electroplated film on the material surface, in which film said composite particles have been codeposited.

3. The composite dispersion electroplating method according to claim 2, wherein said composite particles are formed by mixing the core particles with the shell particles in a predetermined weight ratio, and then performing mechanical encapsulation.

4. The composite dispersion electroplating method according to claim 3 further including immersing an electrolytic material along with said material to be plated in said composite dispersion plating bath, and performing electroplating using the material to be plated as a cathode and the electrolytic material as an anode to form said plating film.

5. The composite dispersion electroplating method according to claim 4 further including circulating the plating solution of said composite dispersion plating bath and blowing air into the plating bath to agitate the plating solution during said electroplating.

6. The composite dispersion electroplating method according to claim 5 further including moving said material to be plated up and down during said electroplating.

7. The composite dispersion electroplating method according to claim 4 further including moving said material to be plated up and down during said electroplating.

8. The composite dispersion electroplating method according to claim 2 further including immersing an electrolytic material along with said material to be plated in said composite dispersion plating bath, and performing electroplating using the material to be plated as a cathode and the electrolytic material as an anode to form said electroplated film.

9. The composite dispersion electroplating method according to claim 8 further including circulating the plating solution of said composite dispersion plating bath and blowing air into the plating bath to agitate the plating solution during said electroplating.

10. The composite dispersion electroplating method according to claim 9 further including moving said material to be plated up and down during said electroplating.

11. The composite dispersion electroplating method according to claim 8 further including moving said material to be plated up and down during said electroplating.

12. A composite dispersion plating bath for an electroplating process wherein a film is plated onto a material immersed in the bath by applying an electrical potential between the plating bath and the material, said composite dispersion plating bath comprising:

a quantity of plating solution having a base metal as its basis, and a plurality of composite particles, each of the composite particles having a core particle and a non-uniform shell composed of a plurality of separate shell particles encapsulating the core particle, the shell particles being composed of the same metal as the base metal of the plating solution.

13. A composite dispersion plating bath as defined in claim 12, wherein:

said shell particles are composed of material selected from the group consisting of nickel, copper, tin, aluminum, chromium, iron and zinc.

14. A composite dispersion plating bath as defined in claim 13, wherein:

said core particle of each composite particle is made of material selected from the group consisting of carbon and $Fe_3O_4$.

15. A composite dispersion plating bath as defined in claim 14 wherein:

said core particle made of carbon has an approximate diameter in the range of about 1 $\mu$m to about 30 $\mu$m; and said core particle made of $Fe_3O_4$ has an approximate diameter in the range of about 1 $\mu$m to about 25 $\mu$m.

16. A composite dispersion plating bath as defined in claim 12, wherein:

said shell particles are composed of material selected from the group consisting of nickel, tin and zinc.

17. A composite dispersion plating bath as defined in claim 16, wherein:

said core particle of each composite particle is made of material selected from the group consisting of carbon and $Fe_3O_4$.

18. A composite dispersion plating bath as defined in claim 12, wherein:

said shell particles are composed of material selected from the group consisting of nickel, copper, tin, and aluminum; wherein:

said shell particles composed of nickel have an approximate diameter less than 1 $\mu$m;

said shell particles composed of copper have an approximate diameter less than 1 $\mu$m;

said shell particles composed of tin have an approximate diameter of about 10 $\mu$m; and said shell particles composed of aluminum have an approximate diameter of about 3 $\mu$m.

* * * * *